US006008706A

United States Patent [19]

Holme et al.

[11] Patent Number: 6,008,706

[45] Date of Patent: Dec. 28, 1999

[54] WIDE BAND CONTIGUOUS MULTIPLEXER HAVING A CONTIGUOUS DIPLEXER

[75] Inventors: Stephen C. Holme, San Ramon; Slawomir J. Fiedziuszko, Palo Alto; Robert N. Seehorn, Redwood City, all of Calif.

[73] Assignee: Space Systems/Loral, Inc., Palo Alto, Calif.

[21] Appl. No.: 09/149,985

[22] Filed: Sep. 9, 1998

[51] Int. Cl.[6] ..... H01P 1/213

[52] U.S. Cl. ..... 333/132; 333/135

[58] Field of Search ..... 333/126, 129, 333/132, 134, 135; 370/297

[56] References Cited

U.S. PATENT DOCUMENTS 3,865,990 2/1975 Kuenemund ..... 333/134 X
5,604,747 2/1997 Callas ..... 333/135 X

FOREIGN PATENT DOCUMENTS 3814-748 9/1989 Germany ..... 333/135
63-9304 1/1988 Japan ..... 333/132

*Primary Examiner*—Justin P. Bettendorf
*Attorney, Agent, or Firm*—Kenneth W. Float

[57] ABSTRACT

An extended band, multiple channel multiplexer 10 well-suited for use with satellite communications systems. The multiplexer utilizes a low attenuation, contiguous diplexer 18 containing contiguous diplexer filters 18*a* to combine two sections 11*a*, 11*b* of the multiplexer respectively containing contiguous channel filters 14*a*, 14*b*. The multiplexer comprises low attenuation, contiguous diplexer filters 18*a* tuned in tandem with channel filters 14*a*, 14*b* to provide contiguous multiplexing. This approach takes advantage of the constructive interaction between these filters to realize an equivalent contiguous multiplexer. This enables realization of a wide band contiguous multiplexer, which heretofore was impossible to tune. The contiguous diplexer eliminates spurious modes of the channel and diplexer filters, spurious waveguide modes, and out of band interaction between the two portions of the multiplexer. Therefore, tuning of the multiplexer is possible.

10 Claims, 3 Drawing Sheets

WIDE BAND CONTIGUOUS MULTIPLEXER HAVING A CONTIGUOUS DIPLEXER

BACKGROUND

The present invention relates generally to multiplexers, and more particularly, to extended band, multiple channel satellite multiplexers.

One conventional multiplexer required the use wide band frequency gap between some of the channels of the multiplexer to realize a multiplexer/diplexer combination, which is pseudocontiguous. Additional directional filters were required to fill the frequency gap and to create contiguous multiplexer. In particular, the prior art approach used a high attenuation diplexer and a directional filter to realize contiguous multiplexing.

It would be desirable to eliminate the directional filters to provide a contiguous multiplexer. Accordingly, it is an objective of the present invention to provide for an extended band, multiple channel satellite multiplexer. It is an objective of the present invention to provide for a contiguous multiplexer that provides wide band performance using low attenuation, contiguous diplexer filters tuned in tandem with channel filters.

SUMMARY OF THE INVENTION

To meet the above and other objectives, the present invention provides for an extended band, multiple channel multiplexer particularly adapted for use with a satellite communications system. The multiplexer comprises low attenuation, contiguous channel filters in first section tuned in tandem with contiguous channel filters in a second section to realize contiguous multiplexing. The directional filters used in the prior art are not needed to realize the contiguous multiplexer of the present invention.

The multiplexer utilizes a low attenuation, contiguous diplexer to combine the two sections of the multiplexer. The approach of the present invention takes advantage of the constructive interaction between these filters to realize an equivalent contiguous multiplexer. This enables realization of a wide band contiguous multiplexer, which previously was impossible to tune. The diplexer eliminates spurious modes of the filters, spurious waveguide modes, and out of band interaction between the two portions of the multiplexer. Therefore, tuning of the multiplexer is possible.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which.

DETAILED DESCRIPTION

Figure 1:
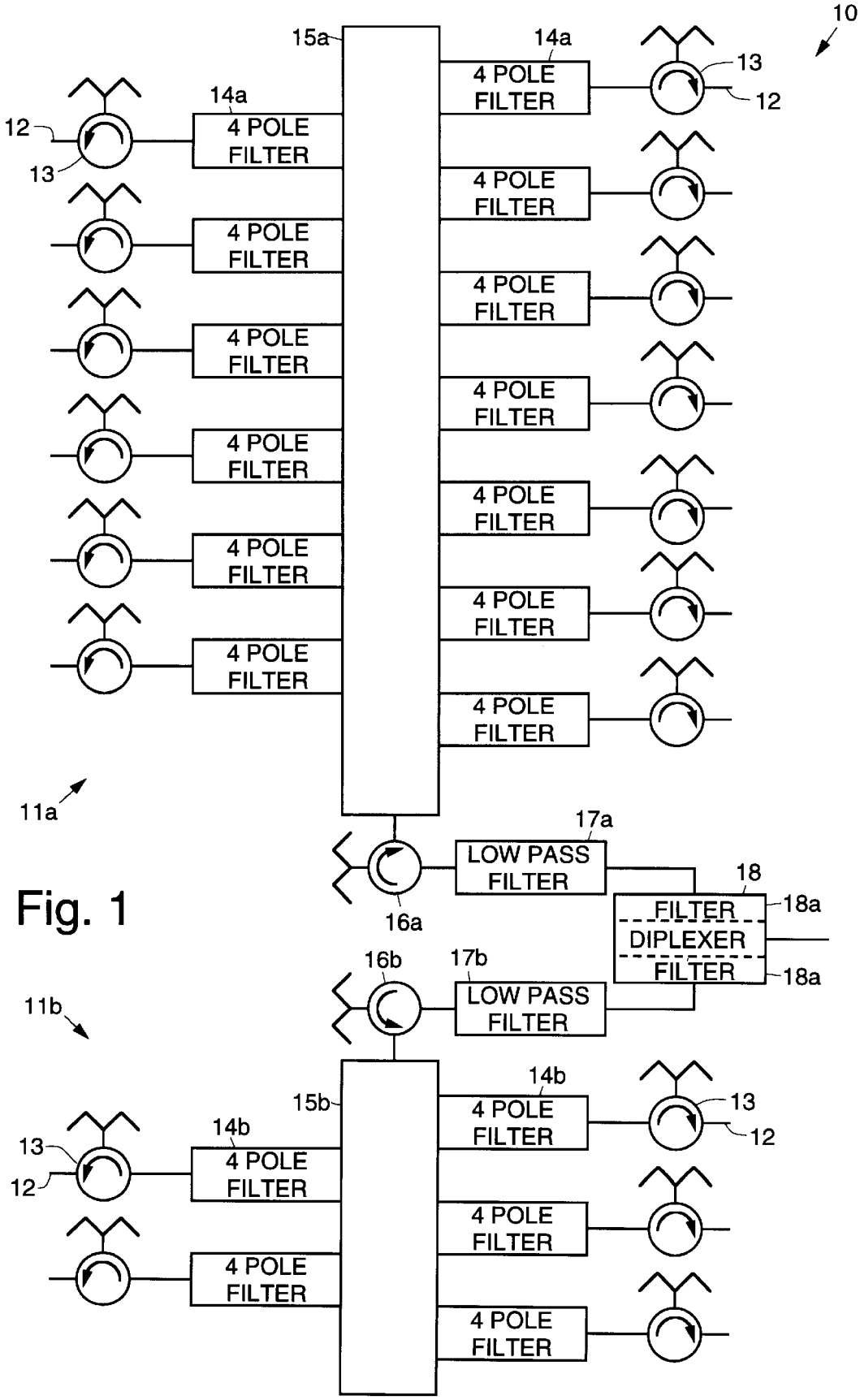
FIG. 1 illustrates an exemplary multiplexer in accordance with the principles of the present invention.

Referring to the drawing figures, FIG. 1 illustrates an exemplary multiplexer 10 in accordance with the principles of the present invention. The exemplary multiplexer 10 comprises first and second sections 11*a*, 11*b*. The first section 11*a* has a plurality of inputs 12 that are respectively coupled by way of a plurality of circulators 13 to a plurality of four-pole channel filters 14*a*. However, it is to be understood that the channel filters 14*a* may have any number of poles dictated by the design and application of the multiplexer 10. Each of the plurality of four-pole channel filters 14*a* are coupled to a first waveguide manifold 15*a*. An output of the first waveguide manifold 15*a* is coupled by way of a first output circulator 16*a* to a first low pass filter 17*a*.

The second section 11*b* has a plurality of inputs 12 that are respectively coupled by way of a plurality of circulators 13 to a plurality of four-pole contiguous channel filters 14*b*. Again, it is to be understood that the channel filters 14*b* may have any number of poles dictated by the design and application of the multiplexer 10. Each of the plurality of four-pole contiguous channel filters 14*b* are coupled to a second waveguide manifold 15*b*. An output of the second waveguide manifold 15*b* is coupled by way of a second output circulator 16b to a second low pass filter 17*b*.

Each of the low pass filters 17*a*, 17*b* is coupled to an input of a contiguous diplexer 18. The contiguous diplexer 18 outputs a multiplexed signal corresponding to the signals input at the inputs 12 of each of the sections 11*a*, 11*b*. In particular, the diplexer 18 is a low attenuation, contiguous diplexer 18 that combines the outputs of the two sections 11*a*, 11*b* of the multiplexer 10.

The channel filters 14*a* are designed and tuned in tandem with contiguous diplexer filters 18*a* of the diplexer 18. This approach is takes advantage of the constructive interaction between the channel filters 14*a* and the contiguous diplexer filters 18*a* to realize an equivalent contiguous multiplexer 10.

The approach of the present invention enables realization of a wide band contiguous multiplexer 10, which previously was impossible to tune. The contiguous diplexer 18 eliminates spurious modes of the channel filters 14*a*, spurious modes in the waveguide manifolds 15*a*, 15*b*, and out-of-band interaction between the two sections 11*a*,11*b* of the multiplexer 10. Therefore, the practical realization (tuning) of the multiplexer 10 is possible.

For the purposes of this description, the words comprise, comprises, or comprising means that a structural element of the invention (such as the multiplexer 10) includes certain components (such as the waveguide manifolds 15*a*, 15*b*, and filters 14*a*, 14*b*), but may also include other components in addition to the recited components. Therefore, the defined structural element of the invention (the multiplexer 10, for example) may have different configurations employing various groups of components, and is not limited to any particular configuration or group of components.

Figure 2:
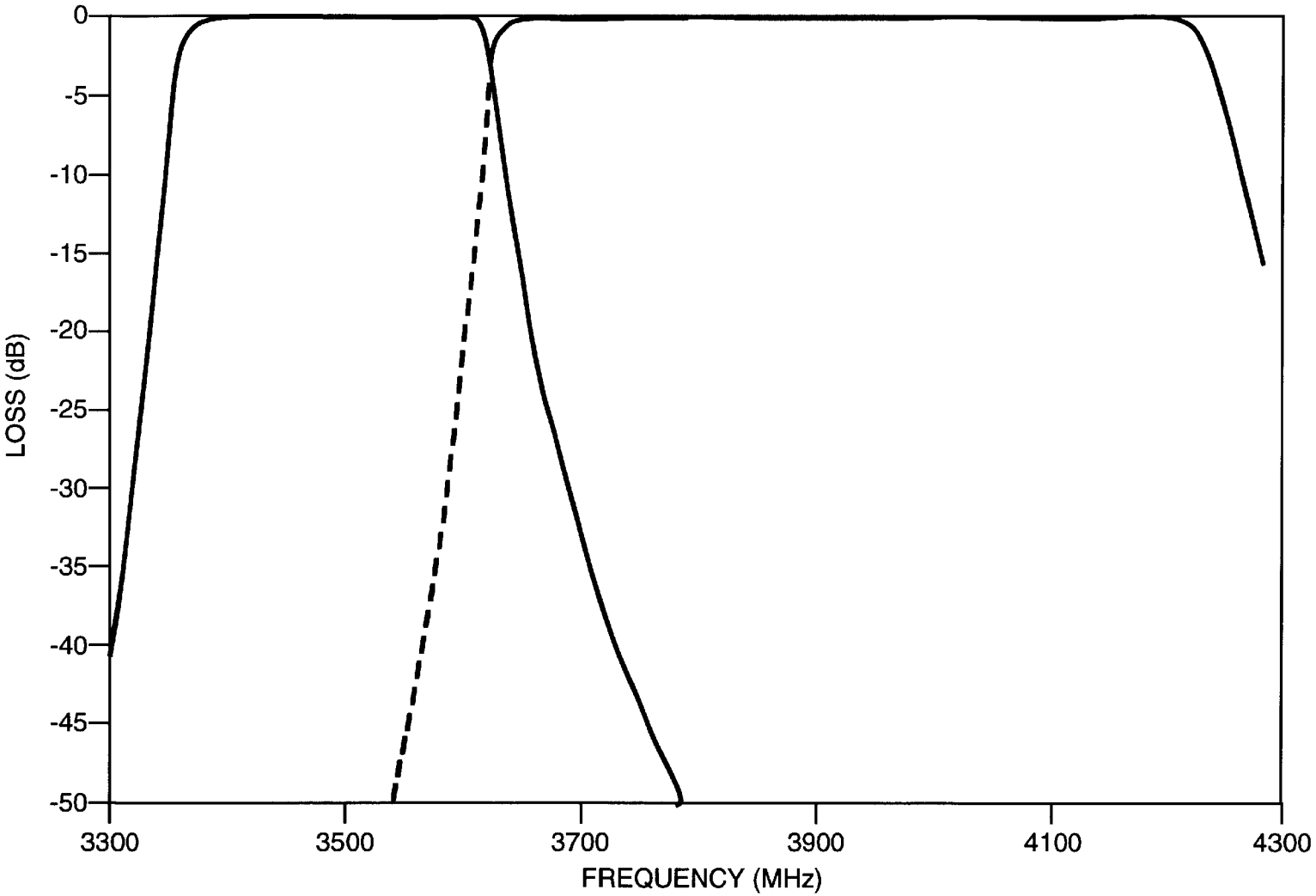
FIG. 2 is a graph that illustrates the response of the diplexer of the multiplexer of FIG. 1 operating at C-band.

FIG. 2 is a graph that illustrates the response of the diplexer 18 of an exemplary multiplexer 10 shown in FIG. 1 operating at C-band. FIG. 2 shows a graph of loss in dB versus frequency in MHz for a C-band implementation of the multiplexer 10. FIG. 2 illustrates the standard or normal band (dashed line) derived from the first section 11*a* of the multiplexer 10, and the extended band (to the left of the dashed line) derived from the second section 11*b* of the multiplexer 10.

Figure 3:
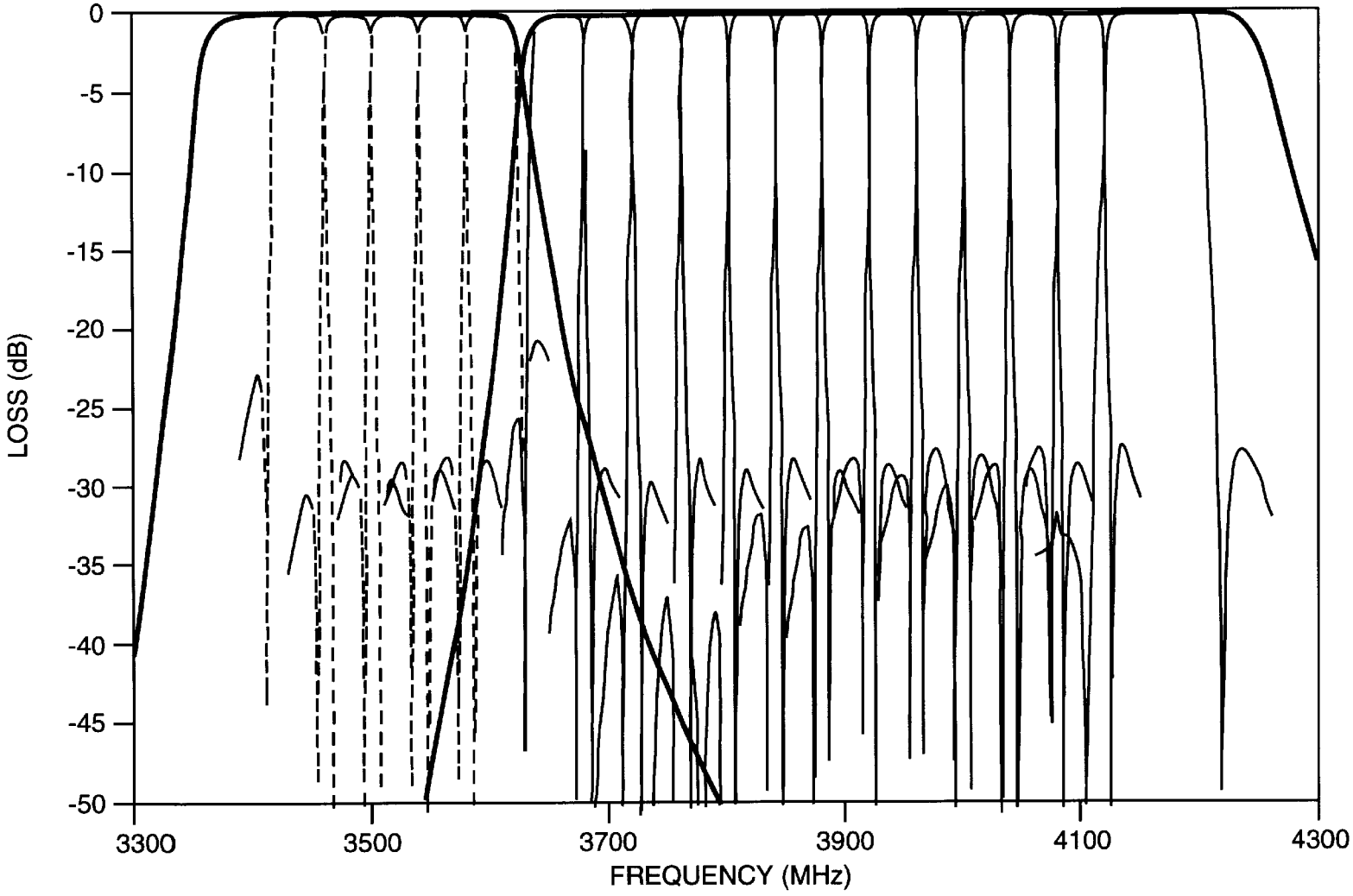
FIG. 3 is a graph that illustrates tuning of the multiplexer of FIG. 1.

FIG. 3 is a graph that illustrates tuning of the exemplary multiplexer 10 of FIG. 1. More specifically, FIG. 3 shows a graph of loss in dB versus frequency in MHz for an exemplary C-band multiplexer 10, such as is shown in FIG. 1. FIG. 3 shows each of the five extended channels derived from the five contiguous channel filters 14*b* of the second section 11*b* and the thirteen standard channels derived from the thirteen contiguous channel filters 14*a* of the first section 11*a*.

While the present invention has been described with reference to an exemplary C-band multiplexer 10, it is to be understood that the present invention is not band-limited. In particular, the concepts of the present invention may be used to produce a multiplexer 10 that operates in the S, C, X, Ku, K, Ka, Q, V, or W frequency bands, for example, or any other desired frequency band. Consequently, the present invention is not limited to any particular operating frequency band.

Thus, an improved multiplexer that provides for extended band, multiple channel satellite communication has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention. For example, the filters employed in the multiplexer may have any number of poles as the application requires, and is not limited to four-pole filter designs used in the disclosed exemplary embodiment.

What is claimed is:

1. A multiplexer comprising:

a first section including a plurality of contiguous channel filters having a first plurality of inputs and a first waveguide manifold respectively coupled to the channel filters;

a second section including a plurality of contiguous channel filters having a second plurality of inputs and a second waveguide manifold respectively coupled to the contiguous channel filters; and a contiguous diplexer coupled to outputs of the first and second waveguide manifolds.

2. The multiplexer recited in claim 1:

wherein the first section further comprises a first output circulator coupled to an output of the first waveguide manifold, and a first low pass filter coupled to an output of the first output circulator; and wherein the second section further comprises a second output circulator coupled to an output of the second waveguide manifold, and a second low pass filter coupled to an output of the second output circulator.

3. The multiplexer recited in claim 1 wherein the channel filters comprise four-pole channel filters.

4. The multiplexer recited in claim 3 wherein the channel filters are designed and tuned in tandem with the contiguous channel filters.

5. The multiplexer recited in claim 1 wherein the diplexer comprises a plurality of diplexer filters and eliminates spurious modes of the channel and diplexer filters spurious modes in the waveguide manifolds and out-of-band interaction between the two sections of the multiplexer.

6. The multiplexer recited in claim 1 wherein the first section comprises a first plurality of circulators coupled between the first plurality of inputs and the plurality of channel filters and the second section comprises a second plurality of circulators coupled between the second plurality of inputs and the plurality of contiguous channel filters.

7. A multiplexer comprising:

a first section including a first plurality of circulators having a first plurality of inputs a plurality of channel filters a respectively coupled to outputs of the plurality of circulators, a first waveguide manifold coupled to each of the channel filters, a first output circulator coupled to an output of the first waveguide manifold, and a first low pass filter coupled to an output of the first output circulator;

a second section including a second plurality of circulators having a second plurality of inputs a plurality of contiguous channel filters respectively coupled to outputs of the second plurality of circulators, a second waveguide manifold coupled to each of the contiguous channel filters, a second output circulator coupled to an output of the second waveguide manifold, and a second low pass filter coupled to an output of the second output circulator; and a contiguous diplexer coupled to outputs of the first and second low pass filters.

8. The multiplexer recited in claim 7 wherein the channel filters comprise four-pole channel filters.

9. The multiplexer recited in claim 8 wherein the channel filters are designed and tuned in tandem with the contiguous channel filters.

10. The multiplexer recited in claim 7 wherein the diplexer comprises a plurality of diplexer filters 18 and eliminates spurious modes of the channel and diplexer filters spurious modes in the waveguide manifolds and out-of-band interaction between the two sections of the multiplexer 10.

* * * * *